US005931264A

United States Patent [19]

Gillingham et al.

[11] Patent Number: 5,931,264

[45] Date of Patent: Aug. 3, 1999

[54] RAIL SURVEY UNIT

[75] Inventors: Geoffrey W. Gillingham, Melbourne; Francis J. Griffiths, Victoria, both of Australia; Timothy M. Remmers, New Hartford, Conn.

[73] Assignee: Otis Elevator Company, Farmington, Conn.

[21] Appl. No.: 08/936,909

[22] Filed: Sep. 25, 1997

[51] Int. Cl.[6] ..... B66B 7/02

[52] U.S. Cl. ..... 187/406; 104/127

[58] Field of Search ..... 187/406, 408, 187/414, 391; 104/127, 307

[56] References Cited

FOREIGN PATENT DOCUMENTS 403098977 4/1991 Japan ..... 187/406

WO 9323323 11/1993 WIPO .

*Primary Examiner*—Kenneth Noland

[57] ABSTRACT

A rail survey unit (130) measures the relative profile of an elevator guide rail (132) at a series of equally spaced points ($a_o$–$a_n$) along the rail (132).

12 Claims, 6 Drawing Sheets

RAIL SURVEY UNIT

TECHNICAL FIELD

The present invention pertains to a device for measuring deviations in an elongated guide rail, or the like.

BACKGROUND OF THE INVENTION

The use of elongated rails to guide or support people conveying vehicles is well known. The rails are typically fixed in a supported structure or on grade, with a series of suspended rollers or wheels placed between the moving vehicle and the fixed rail.

For elevator applications, there are typically two rails disposed on opposite lateral sides of the elevator car and running the entire length of the elevator hoistway. The elevator car, typically suspended by steel ropes from the upper end of the hoistway, or by an hydraulic piston disposed at the hoistway bottom, is guided and centered by the rails as it traverses the hoistway. As will be appreciated by those skilled in the art, any deviation or nonlinearity in the rails will cause the traveling elevator to sway or vibrate as it traverses the nonlinear sections.

A time consuming task during new elevator installations, as well as elevator modernization, is the surveying and straightening of rails which may have been improperly aligned during the installation process, or become misaligned over time due to building settling or other reasons. The misalignment problem is particularly vexing in high rise buildings which typically have high speed elevators and extremely long rails.

The prior art methods of aligning elevator guide rails include the use of one or more wires stretched from the top to the bottom of the hoistway, or a laser beam affixed at one end of the hoistway and directed so as to project adjacent the subject guide rail. In each case, workers traverse the elevator hoistway measuring the position of the guide rail relative to the stretched wire or laser beam in an attempt to accurately determine the position of the rail and any deviations from linearity along its length. As will be appreciated, such procedures are extremely time consuming requiring not only the set up of the laser or wire reference, but also potentially hundreds of painstaking measurements along the guide rail.

An additional complication relates to the nature of high-rise buildings which are, by design, subject to swaying under the influence of wind loading or other live building loads. It is, therefore, common practice to conduct surveys of elevator rails at night when the building is unoccupied and during periods of little or no exterior wind. For measurements using a stretched wire as a reference, it will be appreciated that should the wire be struck inadvertently or moved by air currents during the process, there may be a need to wait until any vibrational movement in the wire has decayed before continuing the rail survey.

Finally, upon completing the survey, workers must then determine which sections along the rail have become misaligned and attempt to reduce or eliminate the misalignment. Guide rails are typically assembled from individual rail segments jointed end-to-end by overlapping fishplates, and supported against the walls of the hoistway by mounting brackets. For misalignments occurring at the segments joints, workers may shim and rebolt the fishplates or grind any protruding segment ends so as to smooth the transition between adjacent segments. For other misalignments, workers may attempt to loosen the mounting bracket, move the rail accordingly, and resecure the rail in the correct position.

Upon completion of the realignment, it is then necessary to again survey the rails to determine if the realignment has been successful.

What is needed is a method and apparatus for reducing the time required to survey an elevator guide rail which is not affected by concurrent building use or external weather conditions.

DISCLOSURE OF THE INVENTION

It is therefore an object of the present invention to provide a device for accurately surveying the lateral profile of an elongated rail, or the like.

It is further an object of the present invention to provide a device for surveying rail profile in two lateral orthogonal axes simultaneously.

It is still further an object of the present invention to provide a device which is capable of surveying rail profile without regard to the occurrence of periodic movement or vibration of the rails caused by internal or external building loading during the time of the survey.

It is still further an object of the present invention to provide a device which determines rail profile by means of a three point measurement of the rail surface taken at a plurality of incremental stops along the rail.

According to the present invention, a rail survey unit is provided which comprises an elongated housing supporting two sets of spaced apart orthogonal fixed rollers. The rollers are placed in contact with the rail being measured and held firmly in place there against by clamping means, such as a second set of spring loaded rollers, or magnetic attraction or a combination thereof.

Spaced apart from both sets of fixed rollers, the survey unit according to the present invention further includes a first and second means for measuring orthogonal lateral position, such as a third pair of moveable rollers urged against the rail by a spring. The measuring rollers each include means, for measuring the lateral position of the measuring rollers relative to the fixed rollers at each end of its housing.

According to the present invention, both sets of fixed rollers and the position measuring rollers are each spaced apart at a distance equal to an integer multiple of a preselected incremental step distance. The survey unit further includes means for measuring longitudinal displacement along the rail, and generating an indication or signal for each incremental step longitudinally traversed by the housing. When positioned against the rail being surveyed and with the fixed rollers firmly engaged with the rail surface, the measuring rollers urged into contact with the surface of the rail as the survey unit traverses the length of the rail.

The device according to the present invention further includes a data recording means for capturing and recording the precise relative displacement of the measuring rollers at each incremental step along the rail. Thus, the device according to the present invention accurately measures relative location, in both lateral directions along the rail at precisely the points at which each fixed roller has been or will be located as future measurements are recorded. The rail survey unit according to the present invention thus increases the accuracy of the collection measurement process while greatly reducing the time required to conduct the rail survey.

By measuring the relative location locally at each point of a series of equally spaced incremental steps over the rail surface, the effects of building vibrations and building sway caused by internal or external building loading are completely eliminated. The rail survey unit according to the present invention requires only two operators and can be used for rail measurement during normal building hours. In practice, the operators ride on the top of the elevator car as it traverses the hoistway at a slow inspection speed, while the rail survey unit is engaged with the elevator rail and traverses the entire length thereof.

According to another embodiment of the present invention, the device is equipped with optical sensors for detecting the occurrence of rail support brackets and splice joints or fishplates disposed between adjacent rail segments. The occurrence of such brackets and joints is recorded, along with their positions along the length of the guide rail. These data may then be used to identify not only at which point the rail profile has most deviated from its intended linear path, but also which rail brackets or joints may be adjusted to correct the deviations.

Both these and other objects and advantages of the survey unit according to the present invention will be apparent to those skilled in the art upon review of the following specification and the appended claims and drawing figures.

BEST MODE FOR CARRYING OUT THE INVENTION

Figure 1:
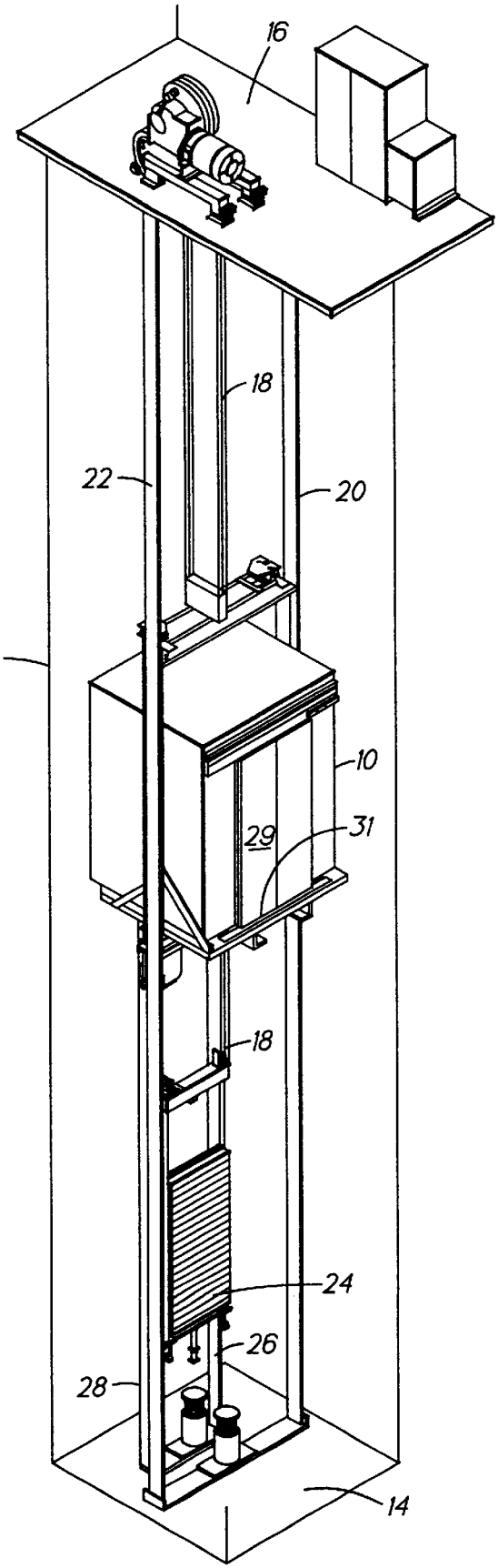
FIG. 1 shows a simplified cut-away view of an elevator and hoistway arrangement.

Referring to the drawing Figures, FIG. 1 shows a typical elevator system arrangement having an elevator car 10 disposed in a hoistway 12 which extends vertically from a lower pit area 14 to an upper machine room area 16. For the roped arrangement shown in FIG. 1, the elevator 10 is suspended vertically by a plurality of ropes 18 and is positioned laterally within the hoistway by first and second guide rails 20, 22. Balancing the weight of the car 10 is a counterweight 24 suspended vertically by means of the ropes 18 and positioned laterally by its own pair of guide rails 26, 28.

As will be appreciated by those skilled in the art, the elevator rails 20, 22 must accurately position the elevator car 10 as it traverses the hoistway 12 in order to ensure proper correspondence of the car doors 29 and threshold 31 with the various hall doors and thresholds (not shown). In addition, as the elevator moves, at speeds of up to 10 meters per second as in modem high-rise buildings, the linearity of the rails 20, 22 is critical in maintaining ride quality.

Slight lateral variations, either front to back or side to side in either or both rails 20, 22 can result in undesirable lateral movement or shaking of the elevator car as it traverses the hoistway 12.

These considerations apply, to a much lesser extent, to the counterweight 24 and its guide rails 26, 28. In this later situation, misalignment of the counterweight guide rails 26, 28 may impact the ride quality of the car 10 indirectly.

As noted hereinabove, nonlinearities occur in the guide rails 20, 22 during installation, as the rails are first installed; during operation, as the elevator moves within the hoistway 12 during normal operation thereby stressing and thereby possibly moving the rails; and due to building settling, thermal expansion, etc., over an extended period of time. For a modem, high-rise, high-velocity elevator system, it is necessary to maintain any misalignment of the elevator guide rails within a close tolerance. It is therefore necessary to precisely measure the profile of the elevator guide rails 20, 22 over their entire length. As will be appreciated by those skilled in the art, the rail segments adjacent the topmost and bottommost elevator landing are less critical due to the fact that the elevator car 10 will always be operating in a decelerating or accelerating mode in such sections and will therefore not achieve full operating speed therein.

Figure 2A:
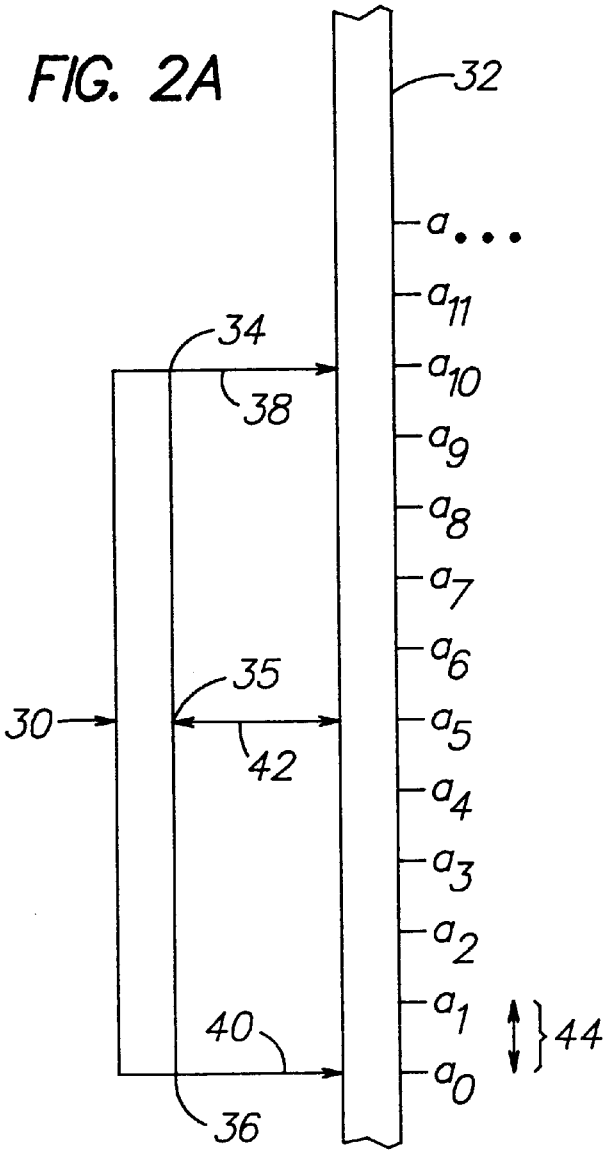
FIGS. 2A and 2B are graphical representations of the operation of the survey unit according to the present invention.
Figure 2B:
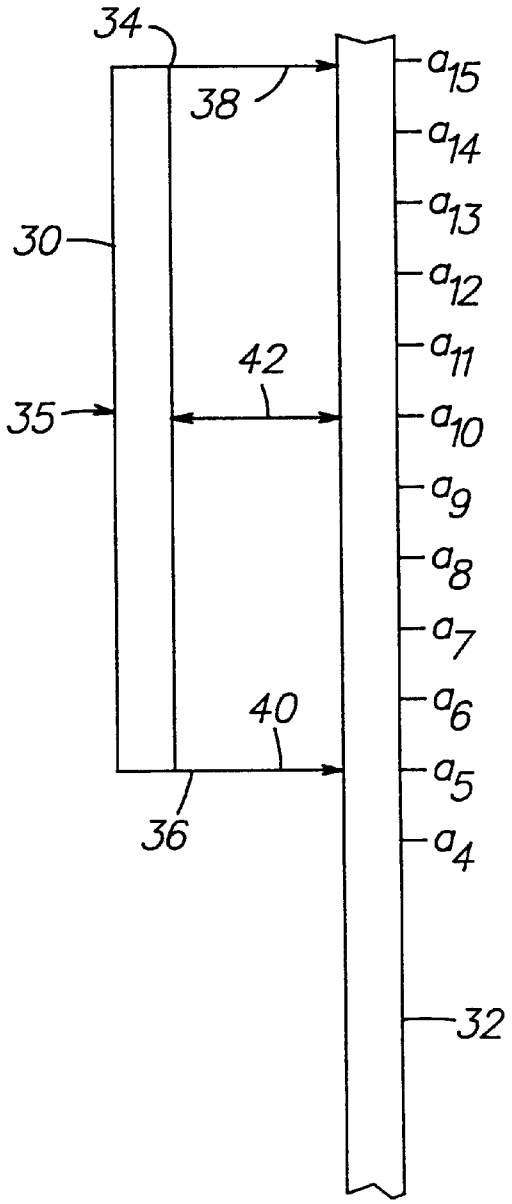

FIGS. 2A and 2B illustrate the general operating principles of the rail survey unit according to the present invention when operated in a single lateral direction. FIG. 2A shows a rigid elongated member 30 schematically representing the rail survey unit disposed adjacent to and substantially aligned with a schematic representation of a guide rail 32. The survey unit 30 operates by determining the exact distance between three distinct locations 36, 35, 34 on the rigid member 30 and three corresponding locations $a_o$, $a_5$, $a_{10}$ on the rail 32. As will be appreciated by those skilled in the art, the three distances 40, 42, 38 corresponding to the pairs of points 36, $a_o$; 35, $a_5$; and 34, $a_{10}$ may be used to determine the exact location of any one of the three rail points, $a_o$, $a_5$, $a_{10}$, provided that the location of the other two rail points are known.

The survey unit 30 according to the present invention measures the exact location of a series of points $a_o$–$a_n$ along the entire length of the rail 32 by continuously repeating the above-mentioned process. By knowing the exact location of any two of the three measured points, a simple trigonometric calculation based on the determined distances 40, 42, 38 will result in the calculation of the location of the third, unknown point. As shown in the accompanying FIG. 2B, the unit 30 according to the present invention is moved along the length of the rail 32 determining the location at subsequent points until the entire length of the rail 32 has been traversed. The relative location data, collected for each point along the rail 32, may then easily be used as a basis to determine the exact local deflection or profile of the rail 32 along its length.

In actual practice, it is unnecessary, more complex, and more expansive to measure the exact distance between the rigid member and the rail at three distinct locations 36, 35, 34. One simple, yet accurate, expedient is to fix the distance between two of the points 36, 35, 34 and the rail 32, by means of a fixed pair of rollers, slides or other constant spacing means. The third location may then employ a measuring sensor, or the like, to measure the third, and hence variable, distance. It should be noted here that the measuring sensor may be placed at any one of the three points 36, 35, 34.

According then to this latest embodiment of the present invention, FIG. 2A shows a rigid member 30 spaced at fixed distances 38, 40 from the rail 32. The distances 38, 40 are maintained by means (not shown) located at spaced apart points 34, 36 on the body of the rigid member 30. A measured distance 42 is determined at a third point 35 which is in turn spaced apart from each of the fixed distance points 34, 36. As illustrated in the Fig., the fixed distance points 34, 36 are located adjacent opposite ends of the rigid member 30, with the measured distance point 35 disposed therebetween. As will be equally appreciated by those skilled in the art, it would be functionally and mathematically equivalent within the scope of the present invention to employ two spaced apart fixed distance points on the body of the rigid member and a third, measured distance point spaced apart from each of the fixed distance points, but not disposed therebetween.

As described above, a rigid member 30 measures and records the distance 42 at a series of equally spaced points $a_o$–$a_n$ along the length of the rail 32. The points $a_o$–$a_n$ are equally spaced at an incremental step distance which may be as small as one centimeter or less.

It will further be appreciated by a review of the FIGS. 2A and 2B that the points 36, 35, 34 on the rigid member 30 are spaced apart in the longitudinal direction by distances which are precisely equal to one or more integer multiples of the incremental step distance 44. Thus, when any one of the fixed or measuring points 36, 35, 34 is longitudinally aligned with any one of the rail points $a_o$–$a_n$, the other two points on the rigid member are likewise aligned with a corresponding rail point. By moving the unit 30 along the rail 32 and measuring the variable distance 42 at only the precise locations wherein the fixed distance points 36, 34 are likewise aligned with a corresponding rail point $a_o$–$a_n$ the unit 30 according to the present invention achieves a high degree of accuracy in relative rail profile measurement.

For example, in FIG. 2A, if it is assumed that the exact locations of $a_o$–$a_9$ are known, it is relatively easy to understand how, by incrementing the rigid member 30 subsequently along the rail 32 by the incremental step 34, how the exact locations and profile displacement of the points $a_{10}$–$a_{19}$ may be determined. In FIG. 2A, for example, using the known locations $a_0$ and $a_5$, along with the knowledge of the fixed distances 40, 38 and the measured distance 42, the precise lateral location of point $a_{10}$ may be determined.

By moving the unit 30 upward incrementally in steps equal to that of the incremental step distance 44, subsequent points $a_{11}$–$a_{14}$ are also measured. FIG. 2B shows a unit 30 being aligned such that the first fixed distance point 36 longitudinally matches rail point $a_5$, intermediate measured point 35 matches point $a_{10}$, and the upper fixed point 34 matches rail point 15. The known location of $a_5$, and the recently calculated position of $a_{10}$, are used, along with the fixed distances 38, 40 and the measured distance 42', to determine the lateral location of rail point $a_{15}$.

In this manner, the entire length of the rail 32 may be traversed quickly by the unit 30 measuring and recording the profile location of the incremental step points $a_1$–$a_n$. By operating the unit 30 in two orthogonal directions, typically, for side mounted elevator guide rails, being the front to back and side to side directions, operators may completely map the profile and any nonlinearities in an elevator guide rail with a single, low speed pass of the survey unit. As most elevators typically utilize only two guide rails, a repetition of this procedure on the second guide rail produces a full group of data for an individual elevator hoistway.

By plotting the relative deviation as shown hereinbelow, operators may quickly determine the location of local deviations and profile nonlinearities.

Figure 3:
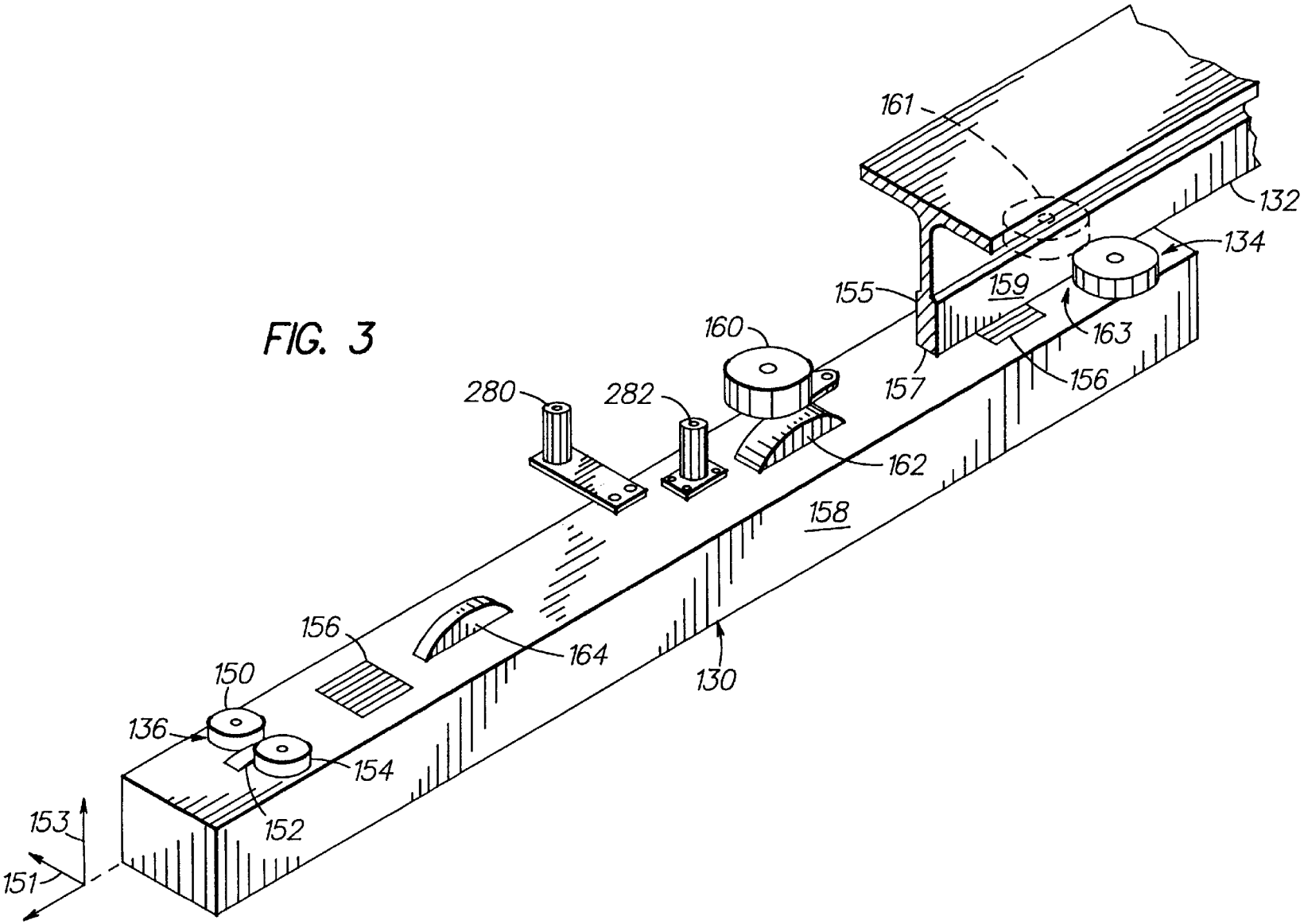
FIG. 3 is an isometric view of a survey unit according to the present invention.

FIG. 3 shows a perspective view of one embodiment of a rail survey unit 130 engaged with a guide rail 132. The survey unit 130 is positioned so as to receive the guide rail 132 in a first support bearing assembly 134 and a second support bearing assembly 136 disposed, in the embodiment illustrated in FIG. 3, at the opposite end of the survey unit 130. Each support bearing assembly 134, 136 includes means 150, 152, 156, 161 for positioning the survey unit 130 in each of two orthogonal directions 151, 153 with respect to the elongated guide rail 132.

In the second support bearing assembly 136, these support means include a first lateral fixed roller 150 and a second lateral fixed roller 152, each having an axis of rotation perpendicular to that of the other, and positioned so as to contact the guide rail 132 on separate orthogonal rail surfaces 155, 157. First support bearing assembly 134 likewise includes a pair of orthogonally oriented fixed rollers 161, 163.

In order to provide firm contact between fixed rollers 150, 152 and 161, 163, and the guide rail 132, the unit 130 according to the present invention includes, for the first lateral fixed roller 150 a first lateral pinching roller 154 having an axis of rotation parallel to the first lateral roller 150 and including an urging means, such as a spring or other resilient forcing means (not shown) for urging the first lateral pinching roller 154 against the rail surface 159, thereby clamping the first lateral fixed roller 150 firmly against the rail 132.

For the second lateral fixed roller 152, 163 the survey unit 130 according to the illustrated embodiment of the present invention include permanent magnets 156, located in a surface of the survey unit housing 158 so as to be adjacent the guide rail 132 and sufficiently close so as to exert an attractive force therebetween. As guide rails 132 are typically made of steel or other ferrous materials, the magnets 156 disposed in the housing 158 operate to pull the unit 130 laterally into contact with the rail 132 and thus causing the second lateral fixed rollers 152, 163 to remain in firm contact therewith.

Also shown in FIG. 3, and moveably mounted to the survey unit housing 158, are first and second lateral position sensing rollers 160, 162. Each of these rollers contact the rail surfaces 155, 157 and are urged into contact with the guide rail 132 by a spring or other resilient forcing means. Each position sensing roller 160, 162 includes means (not shown in FIG. 3) for accurately and precisely measuring the local displacement of the rail 132 contacted by the corresponding positioning sensing roller.

As will further be appreciated by those skilled in the art, and with reference to FIGS. 2A and 2B, it is a feature of the present invention that the points of contact between the fixed rollers 161, 163 and 150, 152 of the respective first and second support bearing assemblies 134, 136 are spaced apart longitudinally an integral number of preselected incremental step lengths from each other, and that each is likewise disposed an integral multiple of incremental steps from the position sensing rollers 160, 162.

Additionally, the embodiment of the rail survey unit of FIG. 3 includes a means for determining the longitudinal displacement of the unit 130 with respect to the rail 132 and for precisely measuring or determining the incremental points at which the unit 130 should measure and record the lateral displacement of the rail 132. This longitudinal measuring means appears, in this embodiment, as an encoder wheel 164 disposed in the housing 138 and urged into rolling contact with the guide rail 132 by means of a spring 206 or other resilient forcing means (see FIGS. 4A–4C). The encoder wheel 164 is equipped for precisely determining the longitudinal movement of the survey unit 130 in units of preselected incremental distance 44, thereby enabling the survey unit 130 to record displacement data as illustrated in FIGS. 2A and 2B.

Figure 4A:
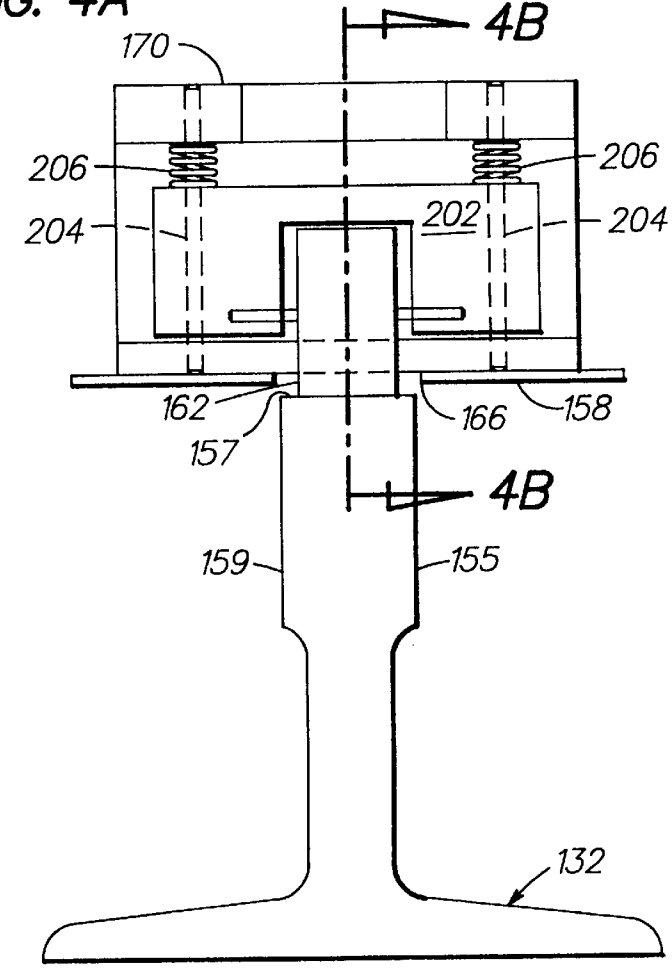
FIGS. 4A, 4B, and 4C are schematic views of one of the lateral position sensor.
Figure 4B:
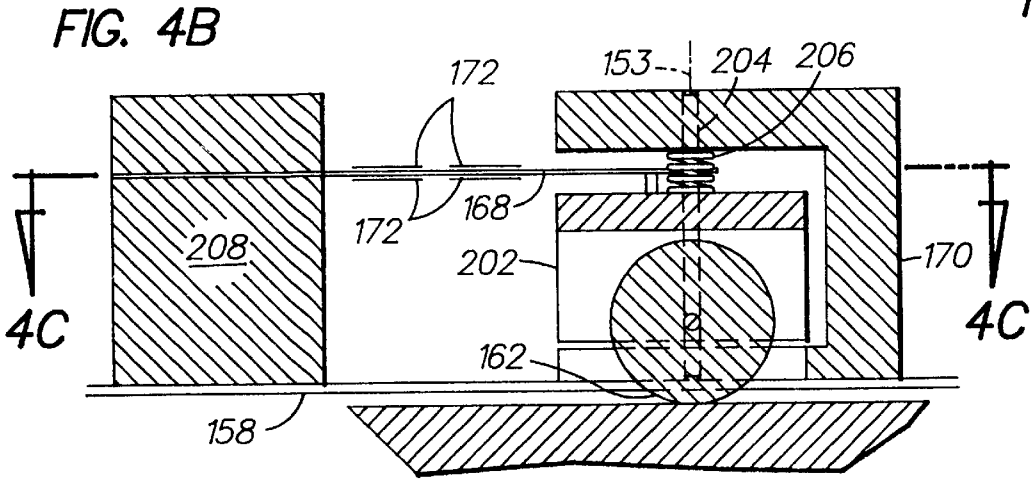
Figure 4C:
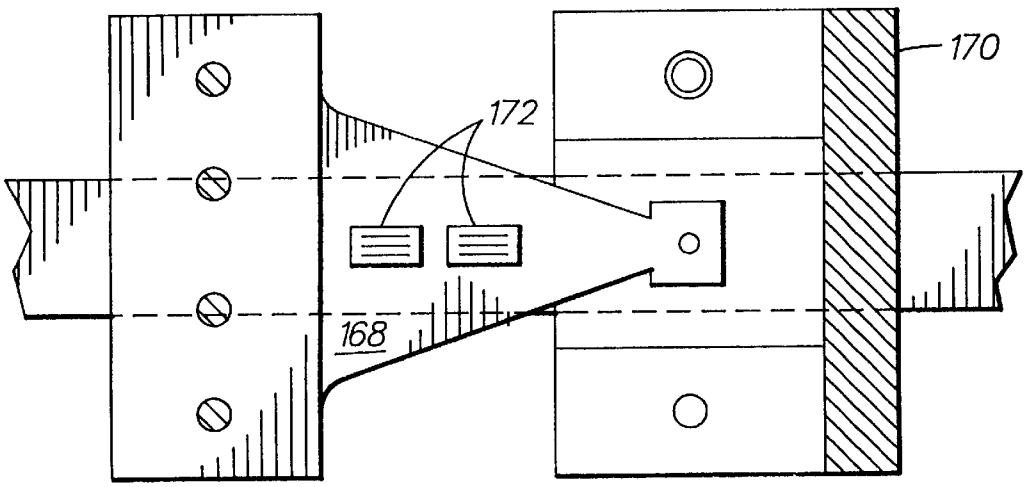

Now referring to FIGS. 4A, 4B and 4C, one of a plurality of possible arrangements of a lateral position sensing roller 162 will be illustrated and described. In FIG. 4A, the roller 162 is shown mounted in a carrier 202 which is in turn supported in a mounting block 170. The carrier 202 reciprocates laterally along pin guides 204 which permit the roller 162 to protrude through an opening 166 in the survey unit housing 158. Compression springs 206 urge the carrier 202 and roller 162 downward as illustrated.

Roller 162 thus contacts the rail surface 157 which extends between the two oppositely facing parallel surfaces 155 and 159 of the rail 132. Any lateral displacement occurring in the rail 132 or perpendicular surface 157 is reflected by a similar magnitude movement in the roller 162 and carrier 202.

FIG. 4B shows the indicated elevation view of the sensor arrangement of FIG. 4A. A flexible member 168 is shown engaged at one end to the carrier 202 and to a clamp block 208 at the other, opposite end. The clamp block 208 is secured to the housing 158 thereby rigidly fixing the clamped end of the flexible member 168.

During operation of the rail survey unit 130, the position sensing roller 162 moves laterally along axis 153 in response to the relative profile of the surface 157. Disposed along the flexible member 168 as illustrated in FIG. 4B are movement sensing strain gauges 172. The use of strain gauges to detect and measure movement is well known in the art, and the electrical arrangement illustrated in FIGS. 4B and 4C is that of a full bridge configuration, insensitive to temperature and other environmental changes. As the flexible member 168 is deformed in response to movement of the carrier 202, strain gauges 172 are, depending upon their individual orientation and mounting, simultaneously stretched or compressed thereby varying the overall resistance of the configuration. This resistance monitored by means well known in the art, provides a signal proportional to the displacement of the carrier 202 and the position sensing roller 162.

It will be appreciated by those skilled in the art that any of a variety of means or methods for accurately measuring the position of the position sensing roller 162 may be utilized in a rail survey unit according to the present invention. Further, it will be appreciated that equivalent position sensing may be achieved without direct contact via rollers or other mechanical means, by use of a proximity sensor, optical sensor or other non-contacting distance measuring element. While the flexible member and electronic strain gauge arrangement shown in FIGS. 4A–4C has proved to be very reliable and hence preferable in this use, those skilled in the art will appreciate that there are many other equivalent embodiments or elements which may be substituted without departing from the spirit or scope of the present invention.

Figure 5A:
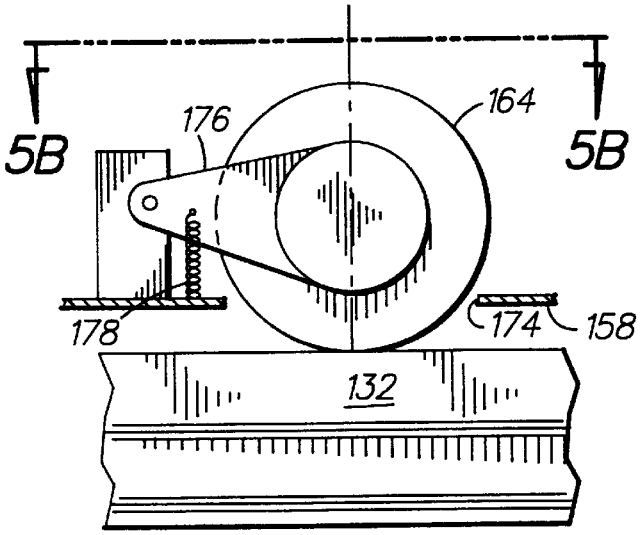
FIGS. 5A and 5B are schematic views of the encoder wheel.
Figure 5B:
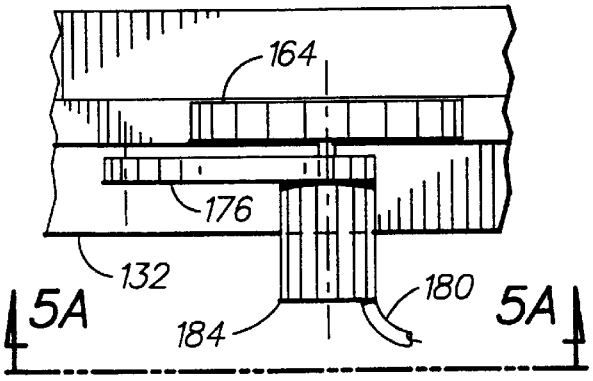

Likewise, FIGS. 5A and 5B which illustrate one possible embodiment of an encoder wheel 164 are likewise intended as only an illustrative depiction of the currently preferred embodiment. FIGS. 5A and 5B show an encoder wheel 164 protruding through an opening 174 in the housing 158. The wheel 164 is supported by a swing arm 176 which includes an urging spring 178 for urging the wheel 164 into contact with the guide rail 132. As the survey unit 130 translates longitudinally along rail 132, encoder wheel 164 rolls thereby rotating an optical sensor 184 connected to the wheel 164. Optical rotary encoder 184, accurately senses the rotation of the encoder wheel 164, and transmit a signal via output wires 180 to a recording means or the like.

Figure 6:
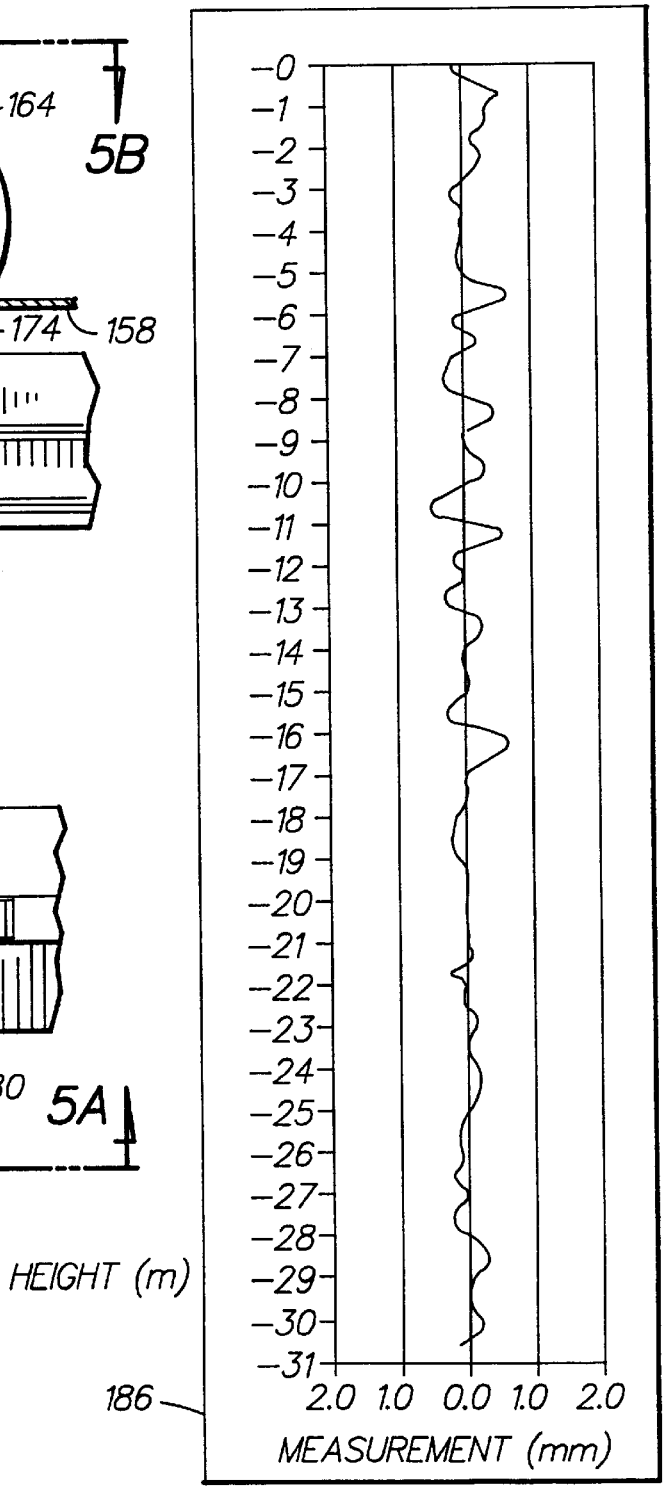
FIG. 6 shows a graphical representation of the data obtained by the rail survey unit during a traverse of an elevator guide rail.

The embodiment of the rail survey unit described hereinabove, is operable for accurately measuring the relative lateral rail profile at a series of closely and evenly spaced incremental locations along the length of the guide rail. By using the data thus collected by the survey unit 130, it is possible to obtain a representation of the relative location of each point $a_o$–$a_n$ in relation to the position of the fixed rollers of the unit along the guide rail length as illustrated by graph 186 in FIG. 6. Graph 186 is a representation of a corrected output signal from a position sensing roller such as is shown in FIG. 4, and plotted over the length of a hoistway. The signal, calibrated in units of millimeters, shows its relative position of the position sensing rollers, at a series of incremental locations $a_1$–$a_n$, with respect to the fixed rollers as illustrated in FIGS. 2A and 2B. By using the relative displacement of the positioning sensing rollers in the first and second lateral directions, it is possible to determine the profiles in a mounted elevator guide rail, and, based on the magnitude of any nonlinearities and their location, take steps to reduce or eliminate such nonlinearities, thereby restoring or achieving improved elevator ride quality.

Figure 7:
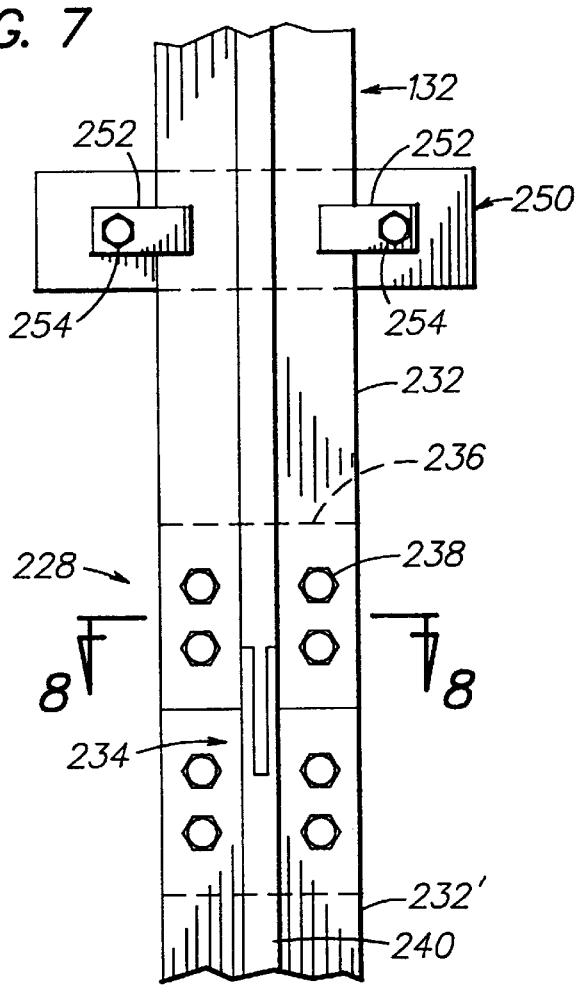
FIG. 7 shows a detailed view of a guide rail support bracket and joint splice.
Figure 8:
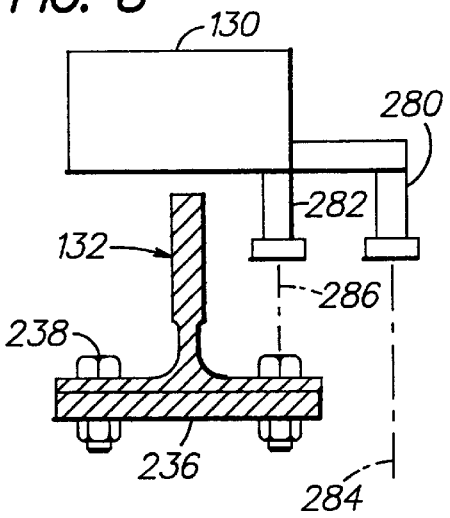
FIG. 8 is a sectional view of a guide rail as indicated in FIG. 7.

FIGS. 7 and 8 illustrate typical mounting and joining arrangements for a guide rail 132 and serve as background for further features of the rail survey unit according to the present invention. Typical elevator guide rails are fabricated of individual sections 232 which are approximately 5 meters in length. Adjacent segments 232, 232' are joined by means of overlapping mortise and tenon members 234 and a joining plate or fishplate 236 disposed on the side of the rail adjacent the hoistway wall and secured by bolts 238. In the illustrated arrangement shown in FIGS. 7 and 8, eight bolts 238, disposed four on each side of the central web 240 of the rail 132, are used. The rail 132 is mounted to the hoistway wall (not shown) by means of a rail mounting bracket 250 which is secured to the hoistway wall. The rail 132 is secured to the mounting bracket 250 by oppositely disposed mounting lugs 252 which are urged in a clamping arrangement against the rail 132 by bolts 254.

As will be appreciated by those skilled in the art, the joints 228 between adjacent segments 232 provide a source of possible misalignment due to inaccurate manufacture or assembly, or deformation during manufacture, shipping or assembly. Likewise, brackets 250, typically disposed at intervals meters along the hoistway represent points of adjustment following determination of nonlinearities in the guide rail 132. Thus, the location of brackets 250 and rail segment joints 228 along the length of the guide rail 132 and, in particular, relative to the measured nonlinearities of the guide rail 132 are a useful and an important parameter for operators.

According to the present invention, first and second optical sensors 280, 282 shown in FIG. 3 are provided for determining the location of both the joints 228 and the brackets 250. In operation, a first optical sensor 280 is positioned so as to direct a beam of light or other sensing energy toward the hoistway wall and just beyond the lateral width of the guide rail 132. (See also FIG. 8). This beam of light 284 proceeds unreflected past the guide rail 132 except at such time as it encounters a rail bracket 250 protruding laterally as shown in FIG. 7. Upon striking a rail bracket 250 light beam 284 is reflected back toward optical sensor 280 whereupon it is received and recorded by the survey unit 130 as a rail bracket location.

Similarly, optical sensor 282 is directed so as to shine a beam of light 286 toward rail 132 and focused so as to encounter the rail joint backing plate mounting bolts 238. By precisely focusing the sensor 282, the rail survey unit 130 according to the present invention can detect the passage of the unit 130 over the joint mounting bolts 238 and, by interpreting the characteristic four bolt sequence, also accurately determine the longitudinal position of the rail joints with respect to the guide rail and incremental measured locations.

It will be well appreciated by those skilled in this art that the rail bracket and joint location sensor described herein is just one of a variety of devices which may be used. Equivalent function and results may readily be obtained from a variety of sensing means, including magnetic or eddy current detectors, physical detection, etc.

Figure 9:
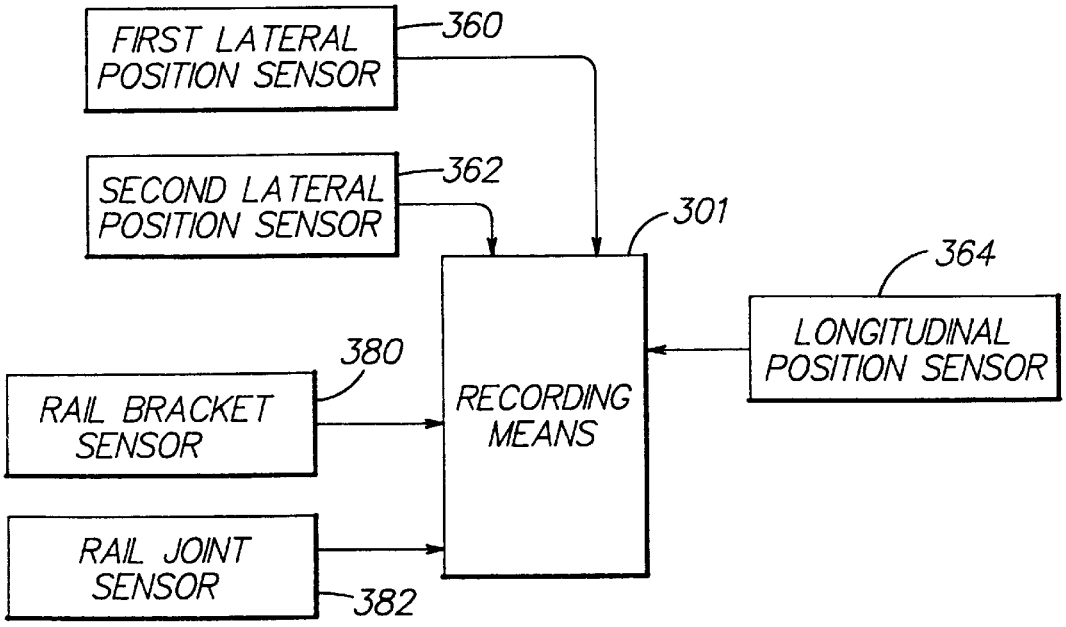
FIG. 9 is a functional diagram of the data recorder.

FIG. 9 shows a functional schematic of a data recording means used by the rail survey unit 132 according to the present invention. An electronic or other recording means 301 receives input signals from the first lateral position sensor 360, second lateral position sensor 362 and the longitudinal position sensor 364. As described hereinabove, the recording means, based upon the longitudinal position sensor providing a signal indicating that the unit 132 (not shown in FIG. 9) has traversed a preselected distance increment along the guide rail 132, records the point location measured by first and second lateral position sensors 360, 362.

As also noted hereinabove, the recording means 301 may additionally receive input signals from the rail bracket sensor 380 and the rail joint sensor 382. By recording the positions measured by the lateral position sensors 360, 362 and the occurrence of signals indicating the presence of brackets and/or rail joints in accordance with the longitudinal position measured in units of preselected distance by the longitudinal position sensor 364, the data recorder 301 stores a complete map or survey of the elevator guide rail 132 which may be analyzed to determine the degree of deflection present in the rail and the need for corrective action.

The recording means may equivalently be any of a variety of electronic or other recording devices for preserving the data collected by the sensors as described in the foregoing specification, and returning this data to the operators upon request.

As will be appreciated by those skilled in the art, the rail survey unit according to the present invention provides a means for accurately determining the relative lateral position of each of a series of incremental locations along the length of the elevator guide rail 132 or the like. As will further be appreciated, the survey unit according to the present invention does not rely on external reference elements to provide an absolute indication of position, but rather measures each location relative to other previously measured locations. Thus, the rail survey unit according to the present invention may be used during periods of building occupancy, wind loading or other situations when prior art methods such as a stretched wire reference or laser beam, etc., would be cumbersome and inaccurate. Further, use of the rail survey unit according to the present invention reduces the time necessary to complete a survey of the guide rails of a typical high-rise building by a factor of 4 or more.

What is claimed is:

1. An apparatus for measuring relative lateral position profile of an elongated rail at a series of discrete longitudinal locations, comprising:

an elongated, rigid housing dispersed substantially parallel to the rail;

a first support bearing, secured to the housing, for locally maintaining the housing a fixed distance from the guide rail;

a second support bearing, spaced apart from the first bearing and secured to the housing, for locally maintaining the housing a fixed distance from the guide rail;

a first lateral position sensor secured to the housing and spaced apart from the first and second bearings, for measuring the local lateral displacement between the housing and the rail;

a longitudinal position sensor secured to the housing for measuring the longitudinal displacement of the housing along the rail in terms of a defined unit of length; and wherein the spacing between each of the first bearing, the second bearing and the first lateral sensor, is an integral multiple of said unit of length.

2. The apparatus as recited in claim 1, wherein:

the first support bearing further comprises means for maintaining the housing a fixed distance from the guide rail in a second lateral axis, said first and second lateral axes each being orthogonal with respect to the other, and the second support bearing further includes means for locally maintaining the housing a fixed distance from the guide rail in the second lateral axis, and further comprising a second lateral position sensor, secured to the housing and spaced apart from the first and second bearings for measuring the local displacement between the housing and the rail along the second lateral axis.

3. The apparatus as recited in claim 2, wherein adjacent discrete longitudinal locations are spaced exactly one predefined unit of incremental distance apart.

4. The apparatus as recited in claim 3, further comprising:

means in communication with the first and second sensors and the longitudinal position sensor, for recording the first lateral axis displacement at each discrete location along the rail.

5. The apparatus as recited in claim 4, wherein the guide rail has a substantially rectangular cross-section defined by two parallel lateral bases and a perpendicular face extending therebetween, and wherein the first bearing comprises a first roller, contacting the perpendicular face and having an axis of rotation parallel to the perpendicular face and perpendicular to the longitudinal rail, said axis of rotation fixedly located with respect to the housing, and a second roller contacting one of the parallel faces and having an axis of rotation parallel to the one parallel face and perpendicular to the longitudinal rail, said axis of rotation fixedly located with respect to the housing.

6. The apparatus as recited in claim 5, wherein the first lateral position sensor includes a first position roller, contacting the perpendicular face of the rail and having an axis of rotation parallel to the perpendicular face and perpendicular to the longitudinal rail, said axis of rotation moveable in a plane perpendicular to the longitudinal rail in response to the local displacement between the housing and the rail, and wherein the second lateral position sensor includes a second position roller, contacting the one parallel face of the rail and having an axis of rotation parallel to the one parallel face and perpendicular to the longitudinal rail, said axis of rotation moveable in a plane perpendicular to the longitudinal rail in response to the local displacement between the housing and the one parallel face.

7. The apparatus as recited in claim 6, further comprising:

means, secured to the housing, for determining the occurrence of the rail support bracket during translation of the housing longitudinally along the rail.

8. The apparatus as recited in claim 6, further comprising:

means, secured to the housing, for determining the occurrence of a rail segment joint during translation of the housing longitudinally along the rail.

9. The apparatus as recited in claim 6, further comprising:

means to urge the first roller into contact with the rail.

10. The apparatus as recited in claim 6, further comprising:

means to urge the second roller into contact with the rail.

11. The apparatus as recited in claim 9, wherein:

the first roller urging means comprises a magnet secured to the housing, and wherein the guide rail comprises a ferrous material.

12. The apparatus as recited in claim 10, wherein:

the second roller urging means comprises a third roller having an axis of rotation parallel to the axis of the second roller contacts the other parallel face and wherein said third roller is spring-loaded with respect to the housing in the direction of the second roller.

* * * * *